US005163686A

United States Patent [19]

Bergman

[11] Patent Number: 5,163,686

[45] Date of Patent: Nov. 17, 1992

[54] PRACTICE MAT FOR GOLFERS

[75] Inventor: Karl A. Bergman, San Diego, Calif.

[73] Assignees: Thomas K. Simonsen; Hans O. Bergman; Bjorn E. Aarskog, La Jolla, Calif.

[21] Appl. No.: 802,540

[22] Filed: Dec. 5, 1991

[51] Int. Cl.[5] ..... A63B 69/36

[52] U.S. Cl. ..... 273/187 A; 434/252

[58] Field of Search ..... 273/187 A, 187 R, 187 B, 273/183 A, 195 R; 283/117; 434/252

[56] References Cited

U.S. PATENT DOCUMENTS

| | | | |
|---|---|---|---|
| 1,484,390 | 2/1924 | Gibbs et al. | 273/187 A X |
| 2,606,026 | 8/1952 | Young | 273/187 |
| 3,350,101 | 10/1967 | Bishop et al. | 273/187 |
| 4,000,905 | 1/1977 | Shirhall | 273/187 |
| 4,164,352 | 8/1979 | O'Brien | 273/187 |
| 4,181,307 | 1/1980 | Krene et al. | 273/187 |
| 4,248,431 | 2/1981 | Bureg | 273/187 |
| 4,915,387 | 4/1990 | Baxstrom | 273/187 |
| 5,071,130 | 12/1991 | Shofner | 273/187 A |

*Primary Examiner*—George J. Marlo
*Attorney, Agent, or Firm*—Brown, Martin, Haller & McClain

[57] ABSTRACT

A practice mat for golfers used in combination with at least one golfer, at least one golf ball and at least one golf club, for indicating the suggested placement of the feet of the golfer, the suggested placement of the golf ball, the suggested alignment of the golf club with the golf ball and the feet of the golfer, and the suggested direction of travel of the head of the golf club. The mat has indicia on a surface. There is indicia including, among others, a plurality of first lines against which a front of a left foot and a front of a right foot of the golfer are placed. There is also at least one second line indicating the placement of a heel of the right foot of the golfer. A plurality of third lines indicates placement of a heel of the left foot for a preselected golf club. A plurality of rectangles indicates placement of the golf ball. There is at least one fourth line indicating the desired direction of travel of the golf ball once the golf ball is struck by the preselected club.

5 Claims, 1 Drawing Sheet

PRACTICE MAT FOR GOLFERS

BACKGROUND OF THE INVENTION

1. Field of the Invention

This invention relates to a golf practice mat to assist in the training of new golfers and to correct the ball addressing techniques and stance of more experienced golfers.

2. Description of the Related Art

U.S. Pat. No. 2,606,026 to B. F. Young on Aug. 5, 1952 shows a golf instructing board having line thereon to position a golfer. It shows where to stand for woods and irons. It also show where to place the ball and provides a semi-circle to aid in follow-through.

U.S. Pat. No. 3,350,101 to F. M. Bishop, et al., on Oct. 31, 1967 describes a golf swing aid having a rubbery pad upon which is drawn several designated paths that a golf club should follow in the swing. The pad indicates where the user should place his feet to properly address the ball.

U.S. Pat. No. 4,000,905 to M. J. Shirhall on Jan. 4, 1977 described a mat with a first set of multiple parallel lines to which the golfers heels are abutted according to the selected club length and the physical stature of the user. A second set of parallel lines perpendicular to the first set indicate points along which a ball may be placed. A third set, consisting of one line, is parallel to the second set and indicates the proper alignment of the trailing foot. There are a plurality of circles to assist in the placement of the balls. A fourth set of lines parallel to the first set indicate the desired travel of the ball once struck. The second set of parallel lines also allows the user to address the ball using different clubs. There are a series of angled lines to assist in the alignment of the forward foot.

U.S. Pat. No. 4,164,352 to J. P. O'Brien on Aug. 14, 1979 shows a golf swing practice mat having a surface of artifical grass. There are markings on the surface to assist the golfer in properly addressing the ball. There are places indicated for the user to stand when using different clubs. The mat has a wedge-shaped device to cant the rear foot. There is a tee placement area.

U.S. Pat. No. 4,181,307 to J. I. Krene, et al., on Jan. 1, 1980 describes a golf training device having a platform upon which the golfer stands at an indicated place. There is a mirror arranged on the platform to allow the user to see his swing as he hits the ball.

U.S. Pat. No. 4,248,431 to D. A. Burnes on Feb. 3, 1981 shows a golfing aid having a base mat and a target line aligned with the intended line of travel of the ball. There is an approach mat placed on the base mat. The approach mat has places indicated for the feet to be placed. There are lines to align the shoulders properly and holes to place balls.

U.S. Pat. No. 4,915,387 to G. D. Baxstrom on Apr. 10, 1990 describes a golf practice and training device having a mat with its upper surface provided with lines to establish foot and shoulder alignment. There are swing path guidelines, ball position indicators and unlofting lines.

None of these patents describes the ball placement feature of the present invention wherein the ball may be placed according to the degree of openness of the club face, nor are the front of the feet aligned as shown. These features allow the golfer to easily and accurately address the ball with a wide selection of clubs and also allow for the differing heights of the golfers.

SUMMARY OF THE INVENTION

Golf pros and experienced golfers agree that in order to properly play the game a person must develop good habit of stance to correctly address the ball. Golf is a game in which attention to seemingly minor details are essential to even an adequate, let alone a winning, performance. The practice mat described in the present invention is designed to optimize the performance of the beginning and the more seasoned golfer.

Repetition is said to be the key to becoming a good golf player. Practice, practice and more practice is needed. A golfer practices on the driving range and during actual games. A golfer must be able to hit a ball consistently along a straight line without unintentionally slicing or hooking the ball. Not being able to consistently address the ball and place it on a fairway or green in the spot chosen is frustrating. The causes of poor performance are not always ascertainable without costly assistance from a professional instructor. This invention can be used by anyone to learn a correct stance for each club used and is simple to learn and use. Many of the mats described in the related art are far too complicated to grasp and tend to discourage learning. They also require the user to position himself or herself exactly on the place indicated. The present practive mat allows the user more latitude in position for personal preference and allows the user to practice in almost any location and may be used in combination with a net or other barrier to impede the distance traveled by the ball in space limited area.

A practice mat for golfers is described herein, used in combination with at least one golfer, at least one golf ball and at least one golf club, for indicating the suggested placement of the feet of the golfer, the suggested placement of the golf ball, the suggested alignment of the golf club with the golf ball and the feet of the golfer, and the suggested direction of travel of the head of the golf club. There is a mat that has indicia on a surface of the mat. The indicia comprises a plurality of first lines against which a front of a left foot and a front of a right foot of the golfer are placed. There is also at least one second line indicating the placement of a heel of the right foot of the golfer. A plurality of third lines indicates placement of a heel of the left foot for a preselected golf club. A plurality of rectangles indicates placement of the golf ball. There is at least one fourth line indicating the desired direction of travel of the golf ball once the golf ball is struck by the preselected club.

The practice mat may comprise indicia on the surface showing at least one first letter next to the first lines indicating the height of a golfer. Further indicia may comprise at least one first numeral next to the third lines indicating a club number of the preselected golf club. At least one second letter next to the third lines, on the surface, may indicate a type of the preselected golf club. There may be, on the surface, at least one word next to the fourth lines indicting the type of the preselected golf club. At least one second numeral next to the rectangles, on the surface, indicates the club number of the preselected golf club.

The first letters next to the first lines may be S, M and T to indicate short, medium and tall golfer heights and where that particular height golfer should stand. The first numerals, on the surface, next to the third lines may be 1,3,5,7 and 9 and indicate the club number chosen for that practice session. The second letters next to the third lines comprise W and I to indicate wood and iron type of preselected golf club. The words next to the fourth lines, on the surface, may be Wood and Iron to indicate the type of preselected golf club. The second numerals next to the retangles, on the surface, may be 1, 3-5, 3-4, 5-6, 7-8, and 9-W, W indicating a wedge type of preselected golf club. There may be a means to transport and store the mat.

The mat is usually made from artificial grass and is approximately 3 feet by 4 feet in size. In operation, the mat is placed on the ground or other surface. The user steps onto the mat and positions herself or himself and the ball on the mat based on the club type and number selected for practice.

It is an object of this invention to provide a golf practice mat to teach beginning golfers a proper stance easily and without undue complication.

It is another object of this invention to provide a golf practice mat that will reinforce proper stance habits to more experienced gofers whose game has indicated that a stance problem may have surfaced.

It is yet another object of this invention to provide a golf practice mat that is inexpensive and easy to use for both the novice and the more experienced golfer.

DESCRIPTION OF THE PREFERRED EMBODIMENT

Figure 1:
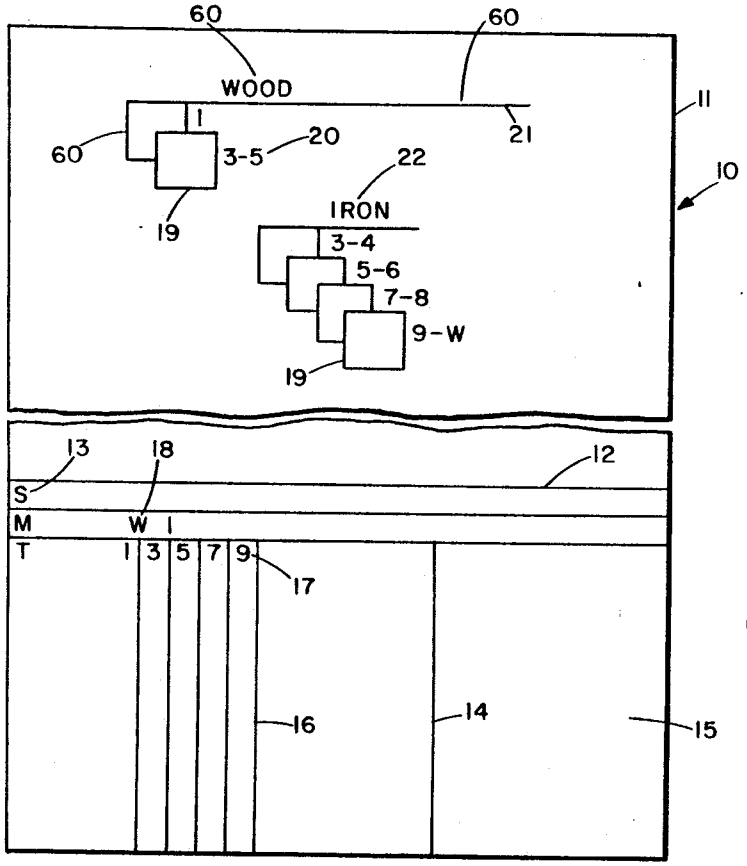
FIG. 1 is a top view of a Practice Mat for Golfers.
Figure 2:
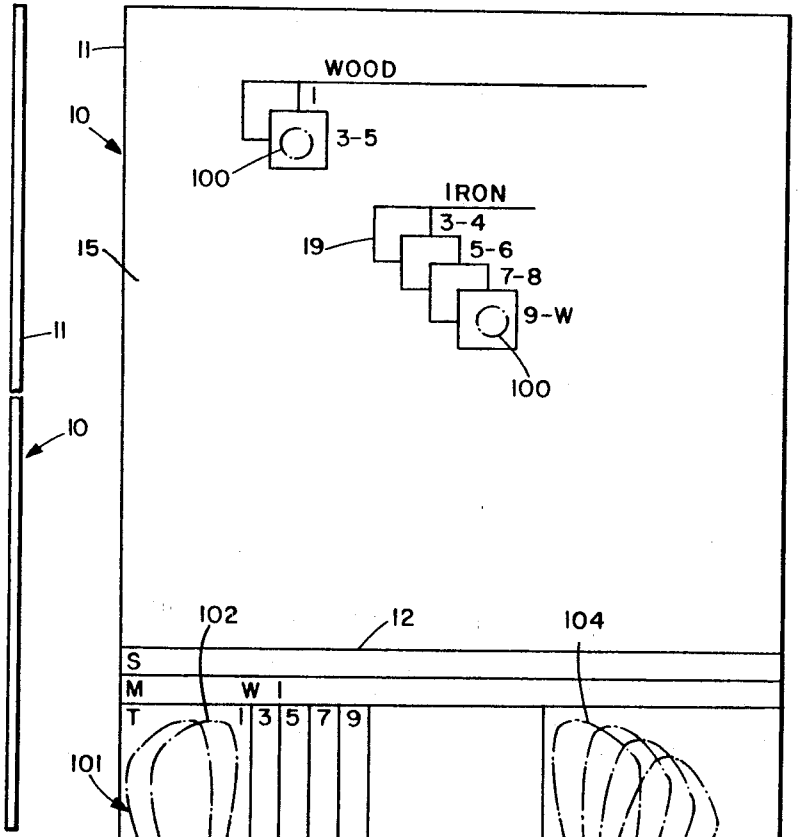
FIG. 2 is a side view of the Practice Mat for Golfers.

FIGS. 1 and 2 show a practice mat 10 for golfers, used in combination with at least one golfer (not shown), at least one golf ball 100 and at least one golf club (not shown), for indicating the suggested placement of the feet 101 of the golfer, the suggested placement of the golf ball 100, the suggested alignment of the golf club with the golf ball and the feet 101 of the golfer, and the suggested direction of travel of the head of the golf club. Indicia 60 may be printed, sprayed or painted on the surface 15 of the mat 11 or placed thereon by any other suitable means or method.

A mat 11 has indicia 60 on its surface 15 comprising a plurality of first lines 12 against which a front 102 of a left foot 103 and a front 104 of a right foot 105 of the golfer are placed. There is at least one first letter 13 next to the first lines 12 indicating the height of a golfer. At least one second line 14 indicates the placement of a heel 106 of the right foot 105 of the golfer on the surface 15 of the mat 11. There are a plurality of third lines 16 indicating placement of a heel 107 of the left foot 103 for a preselected golf club. At least one first numeral 17 next to the third lines 16 on the surface 15 indicate a club number, such as a 9-Iron or a 5-Wood, of the preselected golf club. At least one second letter 18, such as W or I, next to the third lines 16 indicates a type, such as Wood or Iron, of the preselected golf club.

There are a plurality of squares 19 indicating placement of the golf ball 100 on the surface 15 of the mat 11. The squares 19 are larger than the golf ball 100 to allow a plurality of club faces (not shown) to be used to strike the ball. The ball 100 may be placed anywhere within the squares 19. There is at least one second numeral 20, such as 1, 3-5, 3-4, 5-6, 7-8, and 9-W, with W with W indicating a wedge type of preselected golf club, on the surface, next to the squares 19 indicating the club number of the preselected golf club.

At least one fourth line 21, on the surface 15, indicates the desired direction of travel of the golf ball 100 once the golf ball 100 is struck by the preselected club. There is at least one word 22, such as WOOD or IRON on the surface 15, next to the fourth lines 21 to indicate the type of the preselected golf club such as Wood or Iron. There is a means (not shown), such as a bag or at least one strap with a handle, to transport and store the mat 10.

Figure 3:
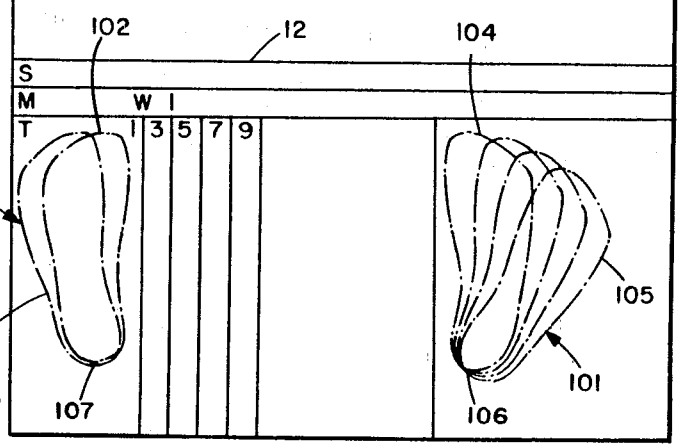
FIG. 3 is a top view of the Practice Mat for Golfers illustrating the operation of the mat.
Figure 4:
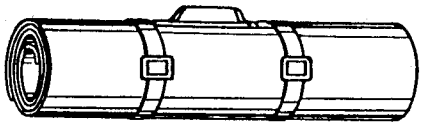
FIG. 4 is a front view of one means for transporting and storing the mat.

In operation, the golfer places the front or toe of his or her right foot against the selected first line 12 chosen to correspond to his height. The heel of the right foot is placed against the second line 14. By having the inside of his heel against line 14 as shown in FIG. 3, the golfer has considerable latitude in foot rotation to accommodate a comfortable position without deviating from proper foot placement.

The third lines 16 are identified according to a specific club (such as for a 5-Iron or a Wood) with which the golfer intends to practice. The golfer places the inside of his left heel against the line selected. Again this positioning of the heel allows the golfer to comfortably place his foot in the proper place for a good stance.

The squares 19 indicate where the balls 100 are to be placed according to the type and number of the club selected by the golfer. The squares are somewhat larger than the balls to allow the golfer to place his ball within the square at a point more comfortable to him and to allow for the varying club faces to be accommodated while still maintaining the proper stance as taught by the golf practice mat. A fourth line 21 provides a guide to the golfer to enable him to place his club perpendicular to both his stance and align the club with the desired flight path of the ball.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A practice mat for golfers, used in combination with at least one golfer, at least one golf ball and at least one golf club, comprising:

a. a mat;

b. indicia on a surface of the mat consisting essentially of a plurality of first lines each having further adjacent indicia differentiating said lines by said golfer's height, and against which a front of a left foot and a front of a right foot of said golfer are placed according to said, height of said golfer;

at least one second line indicating the placement of a heel of the right foot of said golfer;

a plurality of third lines each having further adjacent indicia differentiating said third lines by golf club identity, and indicating placement of a heel of the left foot of said golfer for a preselected golf club;

a plurality of areas, each having further adjacent indicia differentiating said areas by golf club identity, and indicating placement of said golf ball; and at least one fourth line indicating the desired direction of swing of said preselected club and resultant travel of said golf ball once said golf ball is struck by said preselected club.

2. A practice mat as described in claim 1 wherein said further indicia comprise:

at least one letter to indicate said height of said golfer; and at least one alphanumeric indicium to indicate said preselected golf club.

3. A practice mat as described in claim 2 wherein said letters comprise S, M and T to indicate short, medium and tall golfer heights.

4. A practice mat as described in claim 2, wherein said alphanumeric indicium corresponds to the indicium on said preselected golf club.

5. A practice mat as described in claim 4 further comprising indicia to differentiate between the wood and iron type of preselected golf club.

* * * * *